US011497289B2

(12) United States Patent
Hsu

(10) Patent No.: US 11,497,289 B2
(45) Date of Patent: Nov. 15, 2022

(54) HAIR CLIP

(71) Applicant: Kuo-Yang Hsu, Tainan (TW)

(72) Inventor: Kuo-Yang Hsu, Tainan (TW)

( * ) Notice: Subject to any disclaimer, the term of this patent is extended or adjusted under 35 U.S.C. 154(b) by 232 days.

(21) Appl. No.: 17/077,111

(22) Filed: Oct. 22, 2020

(65) Prior Publication Data

US 2022/0125175 A1 Apr. 28, 2022

(51) Int. Cl.
*A45D 8/22* (2006.01)

(52) U.S. Cl.
CPC ..... *A45D 8/22* (2013.01)

(58) Field of Classification Search
CPC ..... Y10T 24/3437; Y10T 24/3435; Y10T 24/3439; Y10T 24/3433; Y10T 24/3407; Y10T 16/53824; A45D 6/145; A45D 6/14; A45D 2/122; A45D 8/20; A45D 8/30; A45D 8/28; A45D 8/22; A45D 8/24
USPC ..... D28/40
See application file for complete search history.

(56) References Cited

U.S. PATENT DOCUMENTS 2,201,719 A * 5/1940 Eicher ..... A45D 8/20 132/277
2,838,055 A * 6/1958 Kertesz ..... A45D 8/20 132/277
D540,982 S * 4/2007 Vergona
7,461,662 B2 12/2008 Kim
7,735,497 B2 6/2010 Kim
8,082,930 B2 * 12/2011 Hsu ..... A45D 8/20 132/277
9,032,973 B2 * 5/2015 Park ..... A45D 8/24 132/277
D794,870 S * 8/2017 Hsu
D850,720 S * 6/2019 Silva
2008/0060670 A1 * 3/2008 Kim ..... A45D 8/20 132/277
2008/0156341 A1 * 7/2008 Longoria ..... A45D 8/20 132/277
2012/0048292 A1 * 3/2012 Tokko ..... A45D 8/20 132/277
2014/0202489 A1 * 7/2014 Yang ..... A45D 8/14 132/277

(Continued)

FOREIGN PATENT DOCUMENTS

KR 200476931 * 4/2015

*Primary Examiner* — Nicholas D Lucchesi
*Assistant Examiner* — Jennifer Gill
(74) *Attorney, Agent, or Firm* — Alan D. Kamrath; Karin L. Williams; Mayer & Williams PC

(57) ABSTRACT

A hair clip includes a lower clip piece having a lower clamping portion, a lower pressing portion, and a lower pivotal portion. An upper clip piece includes an upper clamping portion, an upper pressing portion, and a front pivotal portion. A first elastic coupling device provides a clamping force between the lower and upper clamping portions. A movable clip piece is disposed above the lower clip piece and includes an intermediate pivotal portion and a lower abutting portion behind the intermediate pivotal portion and aligned with the lower clamping portion. The movable clip piece includes a rear abutting portion and a front bent portion bending downwardly and located in front of front ends of the lower and upper clip pieces. A second elastic coupling device abuts the rear abutting portion against an upper side of the upper clip piece when the hair clip does not clamp hair.

4 Claims, 5 Drawing Sheets

(56) References Cited

U.S. PATENT DOCUMENTS

| | | | | |
|---|---|---|---|---|
| 2016/0345703 | A1* | 12/2016 | Hall | A45D 8/20 |
| 2018/0168312 | A1* | 6/2018 | Tsai | A45D 8/30 |
| 2020/0375333 | A1* | 12/2020 | Kim | A45D 8/22 |

* cited by examiner

HAIR CLIP

BACKGROUND OF THE INVENTION

The present invention relates to a hair clip and, more particularly, to a hair clip with improved stability in hair clamping and operation.

A conventional hair clip generally includes an upper clip piece and a lower clip piece having a first end pivotably connected to a first end of the upper clip piece. Each of the upper and lower clip pieces has a pressing portion. An elastic element is disposed to the pivotal connection of the upper and lower clip pieces. When the pressing portions are pressed, second ends of the upper and lower clip pieces move away from the pivotal connection for receiving hair. When the pressing portions are released, the hair is clamped under the elastic force of the elastic element.

However, the second ends of the upper and lower clamping portions away from the pivotal connection are spaced from each other by a spacing, and the hair is apt to disengage from the hair clip via the spacing.

Both U.S. Pat. Nos. 7,461,662 and 7,735,497 disclose an upper clip piece, a lower clip piece, a finger, and a guide loop. An end of the upper clip piece and an end of the lower clip piece are pivotably connected together and are coupled to a coil spring. An intermediate portion of the finger is pivotably connected to a free end of the upper clip piece. A Y-shaped diverging rear end portion protrudes downwardly from the intermediate portion of the finger and faces a gap between the upper and lower clip pieces. The guide loop is disposed behind the finger and has a front end connected to the Y-shaped diverging rear end portion of the finger. The rear end of the guide loop is disposed to the rear end of the upper clip piece. The guide loop is coupled to the Y-shaped diverging rear end portion of the finger to prevent hair from entering the gap between the Y-shaped diverging rear end portion of the finger and the upper clip piece.

However, the above structure requires a guide loop to prevent hair from entering between the finger and the upper clip piece, increasing the component costs. Furthermore, the guide loop has to be actuated when the finger pivots relative to the upper clip member, leading to the risk of non-smooth operation due to the additional component.

BRIEF SUMMARY OF THE INVENTION

An objective of the present invention is to provide a hair clip with improved stability in hair clamping and operation.

A hair clip according to the present invention comprises lower and upper clip pieces, a movable clip piece, and first and second elastic coupling devices. The lower clip piece includes a front end having a lower clamping portion and a rear end having a lower pressing portion and a lower pivotal portion. The upper clip piece is disposed above the lower clip piece. The upper clip piece includes a front end having an upper clamping portion and a rear end having an upper pressing portion. The upper clip piece further includes an upper pivotal portion aligned with the lower pivotal portion. The upper clip piece further includes a front pivotal portion at a front end of the upper clamping portion. The first elastic coupling device is configured to provide elastic coupling between the lower pivotal portion of the lower clip piece and the upper pivotal portion of the upper clip piece and to provide a clamping force between the lower clamping portion and the upper clamping portion. The movable clip piece is disposed above the lower clip piece and includes an intermediate pivotal portion at an intermediate, lower portion thereof. The movable clip piece includes a lower abutting portion behind the intermediate pivotal portion. The lower abutting portion extends downwardly and is aligned with the lower clamping portion. The movable clip piece includes a front bent portion bending downwardly and located in front of the front ends of the lower and upper clip pieces. The movable clip piece further includes a rear end having a rear abutting portion. The second elastic coupling device is configured to provide elastic coupling between the intermediate pivotal portion of the movable clip piece and the front pivotal portion of the upper clip piece. The second elastic coupling device is configured to abut the rear abutting portion of the movable clip piece against an upper side of the upper clip piece when the hair clip does not clamp hair.

In an example, the upper clamping portion includes an upper bent portion bending upwardly, and the movable clip piece includes a slot through which the upper bent portion extends.

In an example, the upper clip piece further includes a coupling groove behind the upper bent portion, and the rear abutting portion of the movable clip piece is positioned in the coupling groove when the hair clip does not clamp hair.

In an example, the lower clamping portion includes two lower claws. The upper clamping portion of the upper clip piece is located above intermediate portions of the two lower claws. The movable clip piece includes three movable claws spaced from each other. A middle one of the three movable claws is aligned with the upper clamping portion of the upper clip piece. One of the two lower claws is located between the middle one of the three movable claws and one of remaining two of the three movable claws. Another of the two lower claws is located between the middle one of the three movable claws and another of the remaining two of the three movable claws. The slot and the intermediate pivotal portion are formed on the middle movable claw.

In an example, the lower pivotal portion of the lower clip piece includes two lower lugs parallel to each other. Each of the two lower lugs has a pivotal hole. The upper pivotal portion of the upper clip piece includes two upper lugs parallel to each other. Each of the two upper lugs has a pivotal hole. The first elastic coupling device includes a first pin and a first torsion spring. The first pin extends through the pivotal holes of the two lower lugs and the two upper lugs and extends through a coil portion of the first torsion spring to thereby pivotably connect the lower and upper clip pieces. Two ends of the first torsion spring abut against the lower and upper clip pieces to provide the lower and upper clip pieces with the clamping force.

In an example, the front pivotal portion of the upper clip piece includes two front lugs parallel to each other. Each of the two front lugs has a pivotal hole. The intermediate pivotal portion of the movable clip piece includes two intermediate lugs each having a pivotal hole. The second elastic coupling device includes a second pin and a second torsion spring. The second pin extends through the pivotal holes of the two intermediate lugs and the two front lugs and extends through a coil portion of the second torsion spring to thereby pivotably connect the movable clip piece and the upper clip piece. Two ends of the second torsion spring abut against the movable clip piece and the upper clip piece.

The lower and upper pressing portions of the lower and upper clip pieces can be pressed open, and a hair clamping portion is formed between the lower claws and both the upper bent portion of the upper clip piece and the movable claws. When hair received in the hair clamping portion abuts against the lower abutting portion of the movable clip piece, the movable clip piece pivots relative to the upper clip piece, and the rear abutting portion disengages from the coupling groove and moves upwardly. The lower side of the upper bent portion of the upper clip piece can receive the hair to increase the amount of hair received. Furthermore, the front bent portion of the movable clip piece can pivot downward and rearward, permitting the hair at the front end of the hair clamping portion can be enveloped by the front bent portion and the lower clamping portion, avoiding disengagement of the hair from the hair clamping portion. The hair clamping stability is, thus, improved.

The present invention will become clearer in light of the following detailed description of illustrative embodiments of this invention described in connection with the drawings.

DETAILED DESCRIPTION OF THE INVENTION

Figure 1:
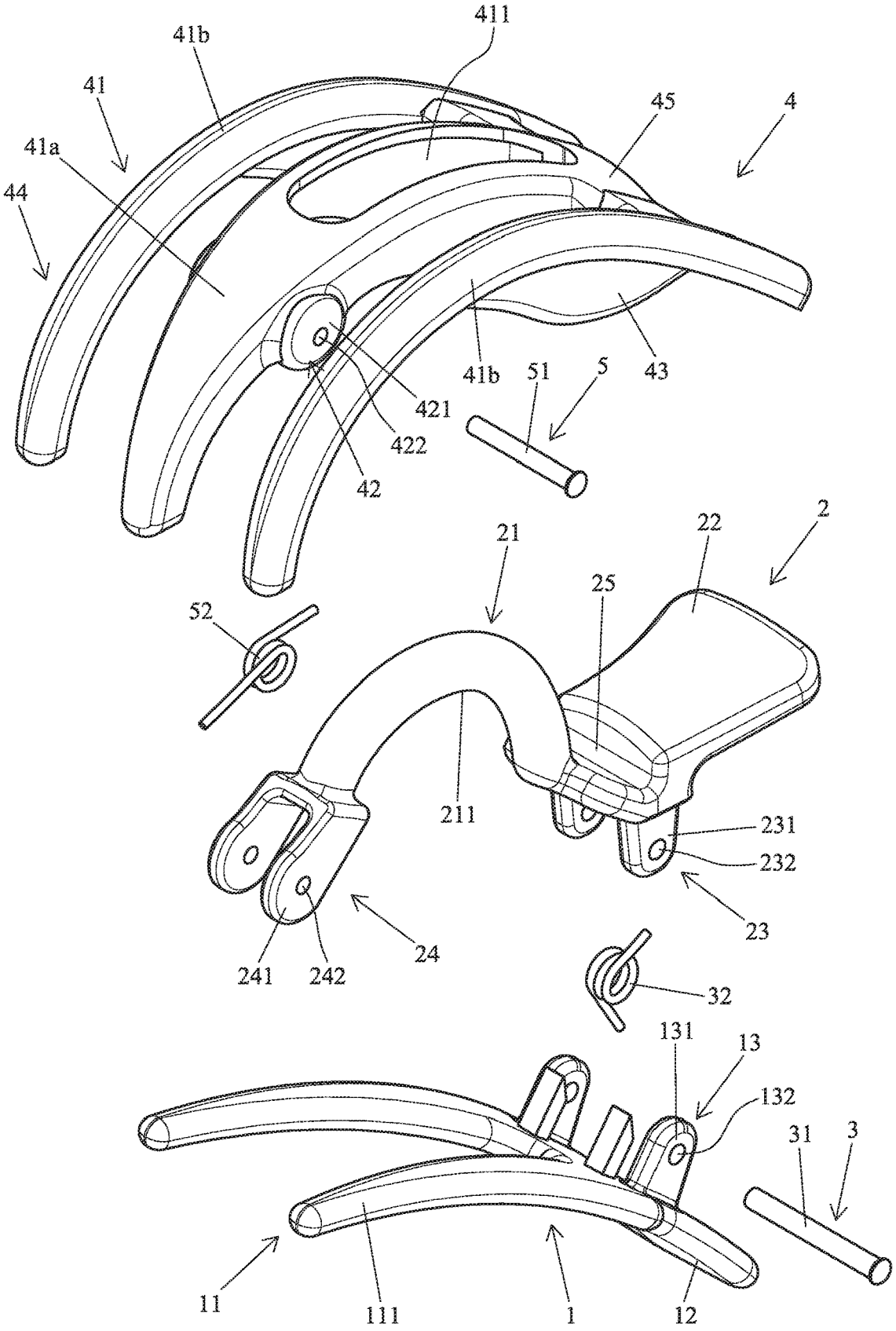
FIG. 1 is an exploded, perspective view of a hair clip of an embodiment according to the present invention.
Figure 2:
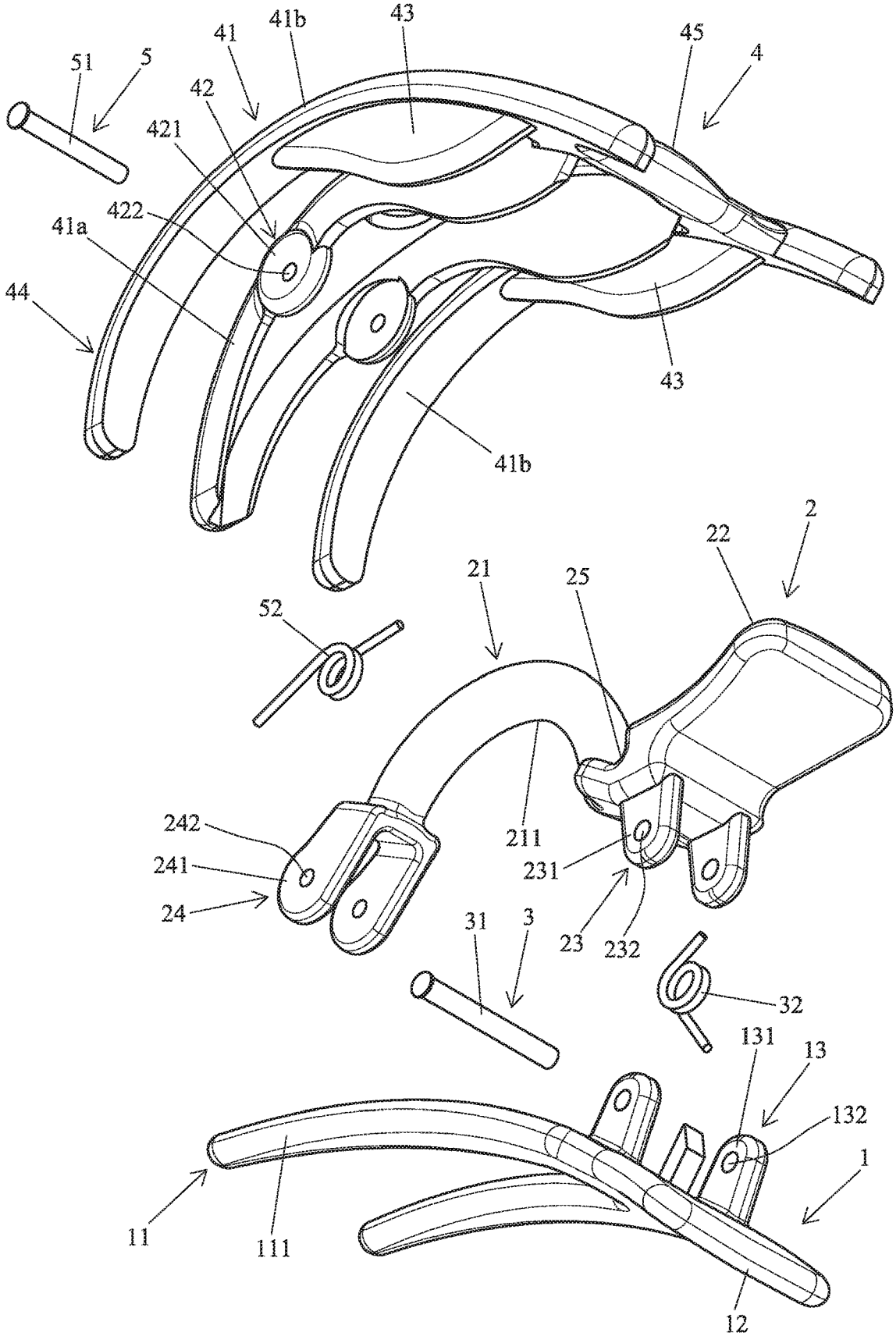
FIG. 2 is another exploded, perspective view of the hair clip of FIG. 1.
Figure 3:
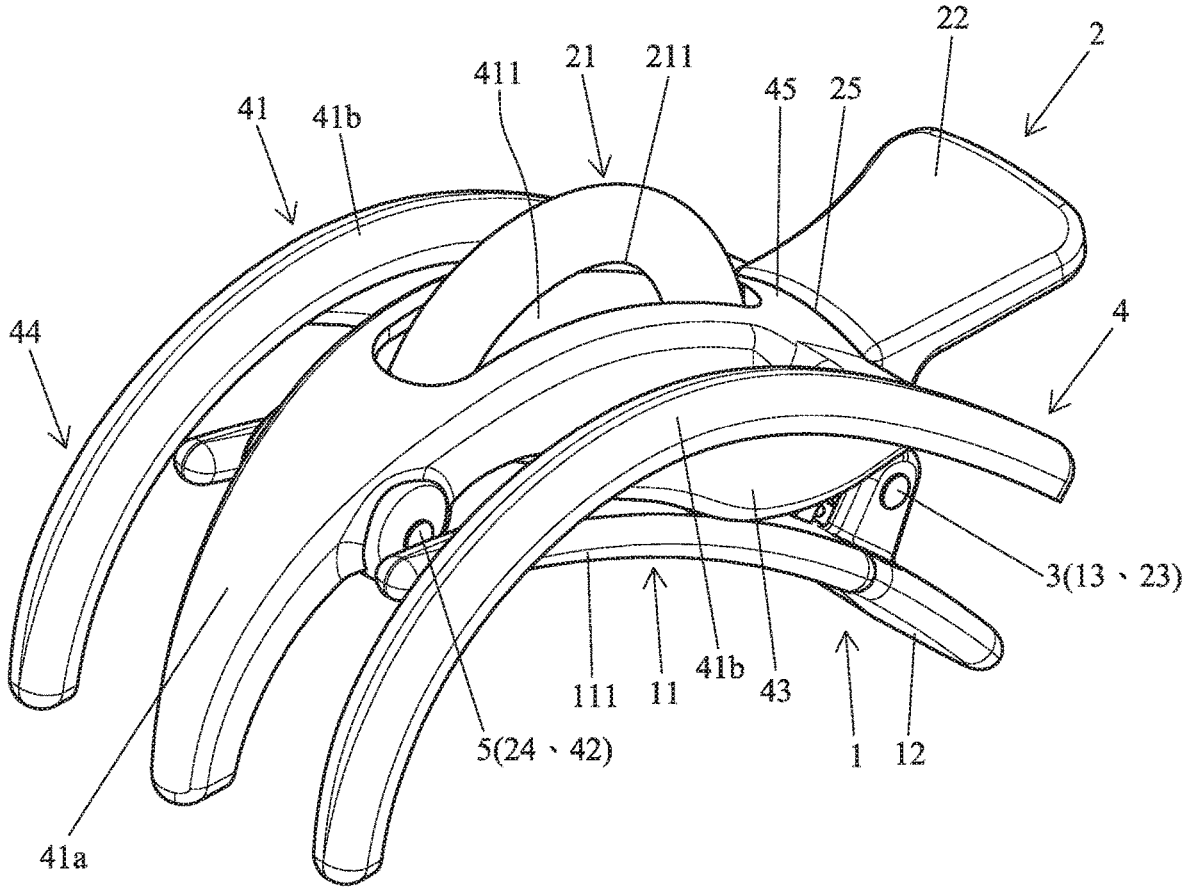
FIG. 3 is a perspective view of the hair clip of FIG. 1 after assembly.
Figure 4:
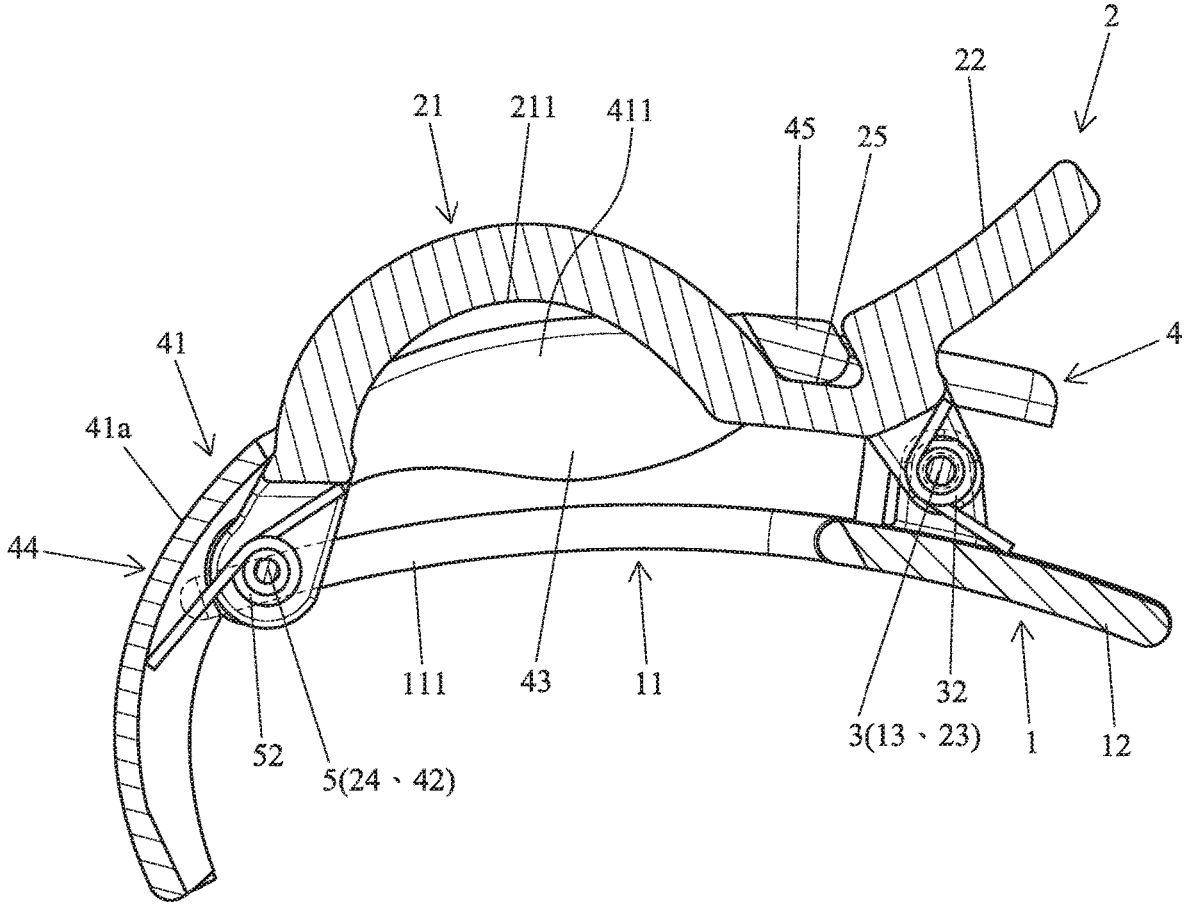
FIG. 4 is a cross sectional view of the hair clip of FIG. 3.

With reference to FIGS. 1-4, a hair clip of an embodiment according to the present invention comprises a lower clip piece 1, an upper clip piece 2, a first elastic coupling device 3, a movable clip piece 4, and a second elastic coupling device 5. The lower clip piece 1 includes a front end having a lower clamping portion 11 and a rear end having a lower pressing portion 12 and a lower pivotal portion 13. The lower clamping portion 11 includes two lower claws 111. The lower pivotal portion 13 is located above the lower pressing portion 12. The lower pivotal portion 13 includes two lower lugs 131 parallel to each other. Each of the two lower lugs 131 has a pivotal hole 132.

The upper clip piece 2 is disposed above the lower clip piece 1 and has a rear end pivotably connected to the lower clip piece 1. The upper clip piece 2 includes a front end having an upper clamping portion 21. The rear end of the upper clip piece 2 has an upper pressing portion 22 and an upper pivotal portion 23.

The upper clamping portion 21 includes an upper bent portion 211 located above intermediate portions of the two lower claws 111 and bending upwardly. The upper pressing portion 22 is aligned with the lower pressing portion 12. The upper pivotal portion 23 is located below the upper pressing portion 22 and includes two upper lugs 231 parallel to each other. Each of the two upper lugs 231 has a pivotal hole 232. The upper clip piece 2 further includes a front pivotal portion 24 at a front end of the upper clamping portion 21. The front pivotal portion 24 includes two front lugs 241 parallel to each other. Each of the two front lugs 241 has a pivotal hole 242. The upper clip piece 2 further includes a top portion having coupling groove 25 behind the upper bent portion 211.

The first elastic coupling device 3 is configured to provide elastic coupling between the lower pivotal portion 13 of the lower clip piece 1 and the upper pivotal portion 23 of the upper clip piece 2. The first elastic coupling device 3 includes a first pin 31 and a first torsional spring 32. The first pin 31 extends through the pivotal holes 132, 232 of the two lower lugs 131 and the two upper lugs 231 and extends through a coil portion of the first torsion spring 32 to thereby pivotably connect the lower and upper clip pieces 1 and 2. Two ends of the first torsion spring 32 abut against the lower and upper clip pieces 1 and 2 to provide the lower and upper clip pieces 1 and 2 with a clamping force.

The movable clip piece 4 is disposed above the lower clip piece 1 and includes three movable claws 41 spaced from each other. The middle movable claw 41*a* is aligned with the upper clamping portion 21 of the upper clip piece 2. One of the two lower claws 111 is located between the middle movable claw 41*a* and one of the remaining two movable claws 41*b*. The other of the two lower claws 111 is located between the middle movable claw 41*a* and the other of the remaining two movable claws 41*b*. The middle movable claw 41*a* includes a slot 411 through which the upper bent portion 211 of the upper clamping portion 21 extends. The middle movable claw 41*a* includes an intermediate pivotal portion 42 at an intermediate, lower portion thereof for pivotal connection with the front pivotal portion 24 of the upper clip piece 2. The intermediate pivotal portion 42 of the movable clip piece 4 includes two intermediate lugs 421 each having a pivotal hole 422. The movable clip piece 4 includes a lower abutting portion 43 behind the intermediate pivotal portion 42. The lower abutting portion 43 extends downwardly and is aligned with the lower clamping portion 11. The movable clip piece 4 includes a front bent portion 44 bending downwardly and located in front of the front ends of the lower and upper clip pieces 1 and 2. The movable clip piece 4 further includes a rear end having a rear abutting portion 45.

The second elastic coupling device 5 is configured to provide elastic coupling between the intermediate pivotal portion 42 of the movable clip piece 4 and the front pivotal portion 24 of the upper clip piece 2. The second elastic coupling device 5 includes a second pin 51 and a second torsional spring 52. The second pin 51 extends through the pivotal holes 422, 242 of the two intermediate lugs 421 and the two front lugs 241 and extends through a coil portion of the second torsion spring 52 to thereby pivotably connect the movable clip piece 4 and the upper clip piece 2. Two ends of the second torsion spring 52 abut against the movable clip piece 4 and the upper clip piece 2. The rear abutting portion 45 of the movable clip piece 4 is positioned in the coupling groove 25 when the hair clip does not clamp hair.

Figure 5:
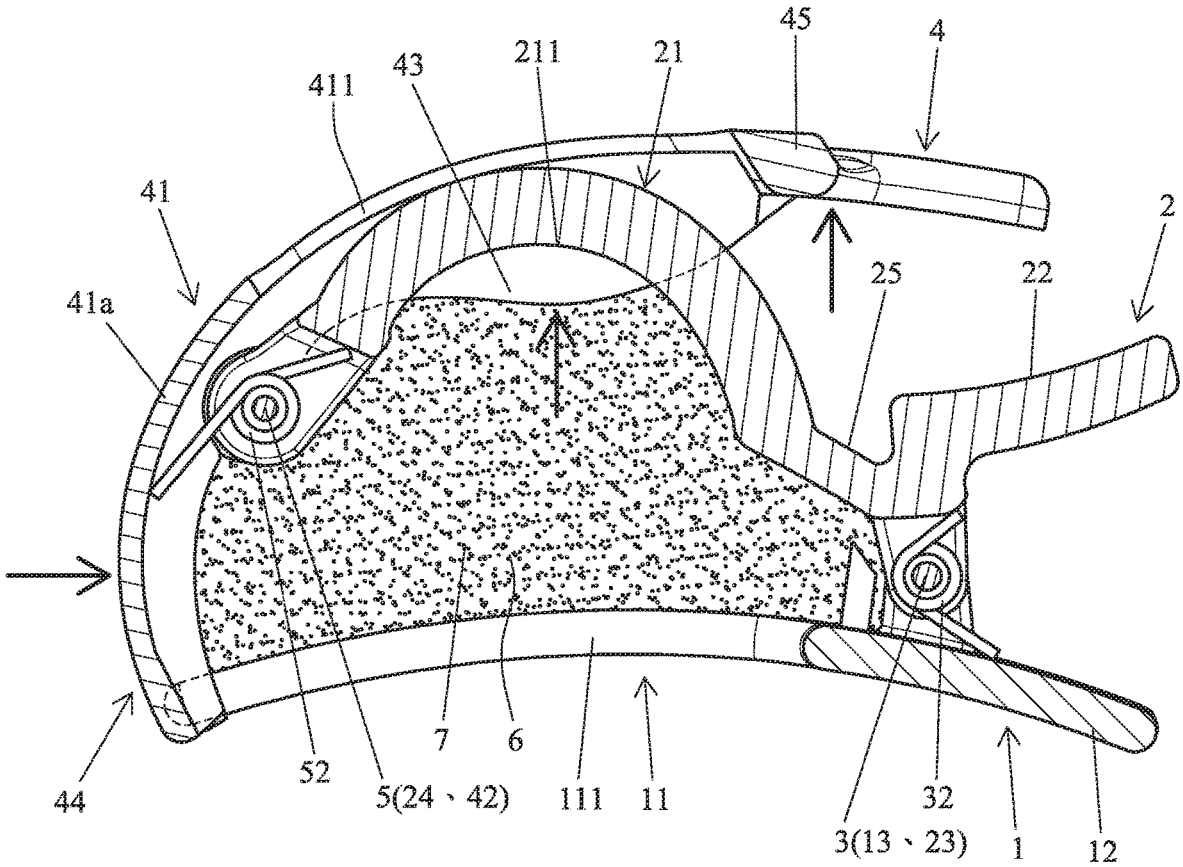
FIG. 5 is a cross sectional view similar to FIG. 4, illustrating hair clamping by the hair clip according to the present invention.

With reference to FIG. 5, the lower and upper pressing portions 12 and 22 of the lower and upper clip pieces 1 and 2 can be pressed open, and a hair clamping portion 6 is formed between the lower claws 111 and both the upper bent portion 211 of the upper clip piece 2 and the movable claws 41. When hair 7 received in the hair clamping portion 6 abuts against the lower abutting portion 43 of the movable clip piece 4, the movable clip piece 4 pivots relative to the upper clip piece 2, and the rear abutting portion 45 disengages from the coupling groove 25 and moves upwardly. The lower side of the upper bent portion 211 of the upper clip piece 2 can receive the hair 7 to increase the amount of hair received. Furthermore, the front bent portion 44 of the movable clip piece 4 can pivot downward and rearward, permitting the hair 7 at the front end of the hair clamping portion 6 can be enveloped by the front bent portion 44 and the lower clamping portion 11, avoiding disengagement of the hair 7 from the hair clamping portion 6.

When the movable claws 41 do not clamp hair, the rear abutting portion 45 is positioned in the coupling groove 25 of the upper clip piece 2, providing improved assembly stability. The movable claws 41 are essentially disposed above the upper clip piece 2, such that the hair 7 will not enter between the movable clip piece 4 and the upper clip piece 2. Thus, the hair clip according to the present invention does not require the conventional guide loop. Furthermore, pivotal movement of the movable clip piece 4 is sufficient to cover the hair 7 by the front bent portion 44, providing improved movement stability. Furthermore, the arrangement of the upper bent portion 211 of the upper clip piece 2 and the slot 411 of the movable clip piece 4 permits the rear abutting portion 45 to be positioned in the coupling groove 25 when the hair clip does not clamp hair, and the upper bent portion 211 permits reception of more hair during hair clamping, improving utility of the hair clip. Furthermore, the two lower claws 111, the upper clamping portion 21, and the three movable claws 41 provide a large hair-clamping area, further improving hair clamping stability.

Although specific embodiments have been illustrated and described, numerous modifications and variations are still possible without departing from the scope of the invention. The scope of the invention is limited by the accompanying claims.

The invention claimed is:

1. A hair clip comprising:

a lower clip piece including a front end having a lower clamping portion and a rear end having a lower pressing portion and a lower pivotal portion;

an upper clip piece disposed above the lower clip piece, wherein the upper clip piece includes a front end having an upper clamping portion and a rear end having an upper pressing portion, wherein the upper clip piece further includes an upper pivotal portion aligned with the lower pivotal portion, and wherein the upper clip piece further includes a front pivotal portion at a front end of the upper clamping portion;

a first elastic coupling device configured to provide elastic coupling between the lower pivotal portion of the lower clip piece and the upper pivotal portion of the upper clip piece and to provide a clamping force between the lower clamping portion and the upper clamping portion;

a movable clip piece disposed above the lower clip piece and including an intermediate pivotal portion at an intermediate, lower portion thereof, wherein the movable clip piece includes a lower abutting portion behind the intermediate pivotal portion, wherein the lower abutting portion extends downwardly and is aligned with the lower clamping portion, wherein the movable clip piece includes a front bent portion bending downwardly and located in front of the front ends of the lower and upper clip pieces, and wherein the movable clip piece further includes a rear end having a rear abutting portion; and a second elastic coupling device configured to provide elastic coupling between the intermediate pivotal portion of the movable clip piece and the front pivotal portion of the upper clip piece, and wherein the second elastic coupling device is configured to abut the rear abutting portion of the movable clip piece against an upper side of the upper clip piece when the hair clip does not clamp hair wherein the upper clamping portion includes and upper bent portion bending upwardly, and wherein the movable clip piece includes a slot through which the upper bent portion extends; and wherein the lower clamping portion includes two lower claws, wherein the upper clamping portion of the upper clip piece is located above intermediate portions of the two lower claws, wherein the movable clip piece includes three movable claws spaced from each other, wherein a middle one of the three movable claws is aligned with the upper clamping portion of the upper clip piece, wherein one of the two lower claws is located between the middle one of the three movable claws and one of the remaining two of the three movable claws, and wherein another of the two lower claws is located between the middle one of the three movable claws and another of the remaining two of the three movable claws, and wherein the slot and the intermediate pivotal portion are formed on the middle movable claw.

2. The hair clip as claimed in claim 1, wherein the upper clip piece further includes a coupling groove behind the upper bent portion, and wherein the rear abutting portion of the movable clip piece is positioned in the coupling groove when the hair clip does not clamp hair.

3. The hair clip as claimed in claim 1, wherein the lower pivotal portion of the lower clip piece includes two lower lugs parallel to each other, wherein each of the two lower lugs has a pivotal hole, wherein the upper pivotal portion of the upper clip piece includes two upper lugs parallel to each other, wherein each of the two upper lugs has a pivotal hole, wherein the first elastic coupling device includes a first pin and a first torsion spring, wherein the first pin extends through the pivotal holes of the two lower lugs and the two upper lugs and extends through a coil portion of the first torsion spring to thereby pivotably connect the lower and upper clip pieces, and wherein two ends of the first torsion spring abut against the lower and upper clip pieces to provide the lower and upper clip pieces with the clamping force.

4. The hair clip as claimed in claim 1, wherein the front pivotal portion of the upper clip piece includes two front lugs parallel to each other, wherein each of the two front lugs has a pivotal hole, wherein the intermediate pivotal portion of the movable clip piece includes two intermediate lugs each having a pivotal hole, wherein the second elastic coupling device includes a second pin and a second torsion spring, wherein the second pin extends through the pivotal holes of the two intermediate lugs and the two front lugs and extends through a coil portion of the second torsion spring to thereby pivotably connect the movable clip piece and the upper clip piece, and wherein two ends of the second torsion spring abut against the movable clip piece and the upper clip piece.

* * * * *